United States Patent [19]

Henry

[11] Patent Number: 4,917,298

[45] Date of Patent: Apr. 17, 1990

[54] METHOD FOR SPRAYING A FIBER-CONTAINING FLUID MIXTURE USING AN AIR ATOMIZING SPRAY GUN

[75] Inventor: David N. Henry, Harvest, Ala.

[73] Assignee: USBI Company, Huntsville, Ala.

[21] Appl. No.: 280,456

[22] Filed: Dec. 5, 1988

[51] Int. Cl.[4] ..... B05B 7/08

[52] U.S. Cl. ..... 239/8; 239/412; 239/569; 239/DIG. 8

[58] Field of Search ..... 239/569, 532, DIG. 8, 239/413, 8, 412

[56] References Cited

U.S. PATENT DOCUMENTS

| | | | |
|---|---|---|---|
| 3,185,396 | 5/1965 | Black | 239/DIG. 8 |
| 3,700,174 | 10/1972 | Beck | 239/532 |
| 3,927,833 | 12/1975 | Harrison et al. | 239/306 |
| 4,640,848 | 2/1987 | Cerdan-Diaz et al. | 427/426 |
| 4,673,594 | 6/1987 | Smith | 427/196 |

OTHER PUBLICATIONS

Sales Brochure–"ASCO Red Hat" Bulletin 8340–Single, Sub–Base and Group Mounted 4 Way Valves.

Sales Brochure–Binks–Air Atomizing Automatic Guns.

*Primary Examiner*—Andres Kashnikow

*Assistant Examiner*—Karen B. Merritt

[57] ABSTRACT

A method of spraying fiber-containing fluids that results in smoother, more uniform coatings. The method comprises displacing a fiber-containing fluid through a nozzle assembly at about 69 KPa to about 386 KPa. The fibers have a length of about 1 mm to about 6 mm. The nozzle assembly comprises a nozzle extension, an elbow joint, and a nozzle in series communication through at least two hollow fluid passages. A first fluid passage exits at a first nozzle outlet having a diameter of about 2.5 mm to about 3.5 mm. A second gas passage exits at a second nozzle outlet and directs a gas at the fiber-containing fluid to atomize the fluid. Control means are disposed upstream of the nozzle assembly for controlling the fiber-containing fluid flow and the gas flow.

1 Claim, 2 Drawing Sheets

METHOD FOR SPRAYING A FIBER-CONTAINING FLUID MIXTURE USING AN AIR ATOMIZING SPRAY GUN

TECHNICAL FIELD

The field of art to which this invention pertains is methods for spraying fiber-containing fluids and particularly methods for spraying fiber-containing fluids using air atomization spray guns.

BACKGROUND ART

Air atomizing spray guns direct a stream(s) of air at a fluid stream as it exits the nozzle to atomize the fluid stream. As shown in FIG. 1, many conventional air atomizing spray guns use a needle valve assembly to regulate fluid flow. A needle valve allows for extremely accurate control of the fluid stream at the point of delivery (e.g., the needle tip). The needle valve assembly has a needle disposed in the fluid passage of a nozzle. The needle end seats in the nozzle tip effectively cutting the fluid flow. A variety of means are used to displace the needle through the fluid passage such as trigger activated spring driven pistons and air cylinder driven pistons. Some spray guns are equipped with such features as nozzle extensions and elbow joints which facilitate the spraying of difficult to reach places such as pipe interiors. Nozzle extensions are provided with extra long needles and elbow joints are provided with cam assemblies to translate the direction of the needles.

Generally, these spray guns work well, however there is a constant search for improvements particularly when spraying mixtures such as fiber-containing fluids.

DISCLOSURE OF INVENTION

This invention is directed to a method of spraying fiber-containing fluids that results in smoother, more uniform coatings. The method comprises displacing a fiber-containing fluid through a nozzle assembly at about 69 KPa to about 386 KPa. The fibers have a length of about 1 mm to about 6 mm. The nozzle assembly comprises a nozzle extension, an elbow joint, and a nozzle in series communication through at least two hollow fluid passages. A first fluid passage exits at a first nozzle outlet having a diameter of about 2.5 mm to about 3.5 mm. A second fluid passage exits at a second nozzle outlet and directs a gas at the fiber-containing fluid to atomize the fluid. Control means are disposed upstream of the nozzle assembly for controlling the fiber-containing fluid flow and the gas flow.

The foregoing, and other features and advantages of the present invention will become more apparent from the following description and accompanying drawings.

BEST MODE FOR CARRYING OUT THE INVENTION

Figures 2, 3:
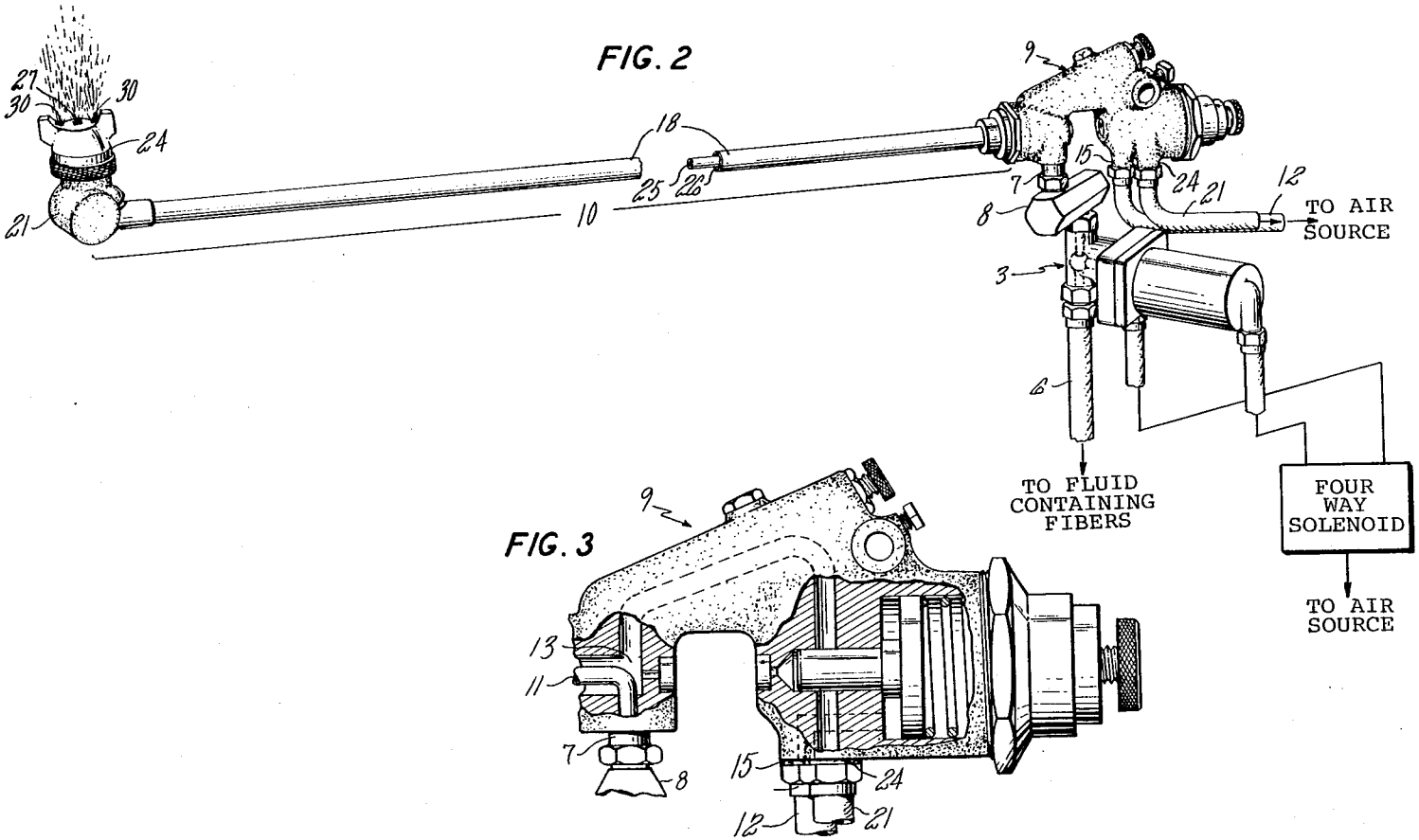
FIG. 2 illustrates a perspective view of the spray gun of this invention.
FIG. 3 illustrates a side view partly broken away and partly in section of a portion of the spray gun of this invention.

According to FIG. 2 which shows the spray gun in perspective, a control means such as a pneumatic ball valve 3 controls the flow of fiber-containing fluid from hose 6 to port 7 on spray gun housing 9. Elbow joints 8 may be used to locate the ball valve 3 towards the rear of the housing 9 to facilitate spraying of hard to reach places. The fiber-containing fluid flows through a first fluid passage 11, disposed in housing 9, to the nozzle assembly 10. Air hose 21 supplies atomization air to port 24 which flows through a second gas passage 13, disposed in the housing 9, to the nozzle assembly 10. A control means such as an air actuated spring loaded cylinder controls the flow of atomization air. For example, air hose 12 provides a controlled flow of air (cylinder air) to port 15 on spray gun housing 9. The cylinder air from port 15 displaces a spring loaded cylinder disposed within housing 9. As the cylinder moves it opens the second gas passage 13 (atomization air gas passage) through the housing to nozzle assembly 10. When the cylinder air from hose 12 is turned off the spring loaded cylinder closes the second gas passage 13 (atomization air fluid passage) through the housing 9.

The fluid containing fiber and atomization air exits the gun housing 9 and enters the nozzle assembly 10. In the direction of flow, the nozzle assembly 10 comprises a nozzle extension 18, elbow 21, nozzle 24 and nozzle outlet 27 in fluid communication. There are separate passages in the nozzle assembly 10 for the atomization air and the fluid containing fiber. The passages may be disposed in a variety of configurations such as the atomization air passage 26 disposed surrounding an inner fluid flowpath 25. The fluid containing fiber flows through the nozzle assembly 10 exiting at the nozzle outlet 27. The atomization air flows through the nozzle assembly 10 exiting at ports 30. The stream of high pressure atomization air is directed at the fluid stream as it exits the outlet 27 in order to atomize the fluid stream into a spray.

The nozzle outlet has a diameter selected according to the desired application. However, small diameters (e.g., about 2.5 mm to about 3.5 mm) provide smoother, more uniform coatings reducing fiber clumping that can result in a coating appearance called "orange peeling". It these same small orifice nozzle outlets that result in the clogging described below.

Figure 1:
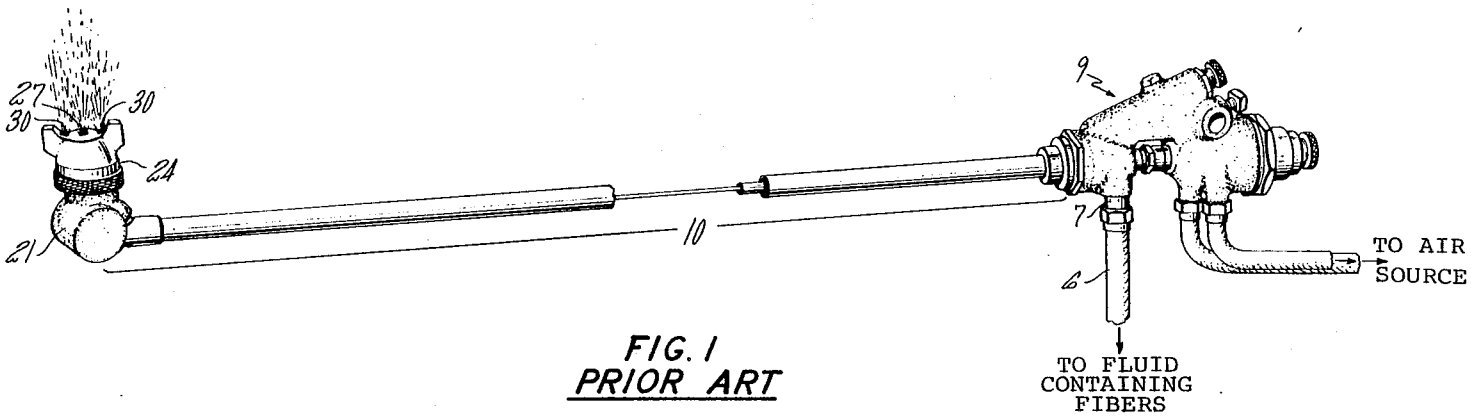
FIG. 1 PRIOR ART
FIG. 1 illustrates a perspective view of a conventional spray gun.

The spray gun housing 9 is a modified version of an air atomization automatic gun such as Model 61 or Model 610 available from Binks Company (Chicago, IL) as depicted in FIG. 1. The modification comprised removing the needle valve that controlled the fluid stream and plugging the hole(s) left in the housing. In addition, the nozzle assembly is a modified version of one available from Binks Company such as Model EB extension assemblies. The modification made was to remove the needle valve assembly that was disposed within the fluid passage and controlled the fluid flow. The needle valve assembly includes a needle 1, that is controlled at the gun housing by the cylinder air and seats at the nozzle outlet, and a cam assembly disposed in the elbow joint which changes the direction of the needle valve. It has been found that this modification was critical to the sprayinq of fiber-containing fluids. Particularly for the fiber sizes described below the fluid passage becomes clogged with fibers at the cam assembly and the area where the needle valve seats.

The liquid stream is preferably under pressures of about 69 KPa (10 psi), to about 386 KPa (40 psi). Below about 69 KPa, the spray sputters and above about 386 KPa, the coatings tend to sag. This stream may utilize a wide variety of liquids such as surfactants, solvents, etc.

The liquid stream is combined with fibers to form a mixture. These mixtures are used in coatings. Typically, the fibers have a length of about 1 mm to about 6 mm, preferably about 3 mm to about 5 mm, and a diameter of about 6 microns to about 13 microns. However, other particles such as microballoons, eccospheres or powders may be used. Exemplary fibers include glass, carbon, graphite and ceramic which are available from such suppliers as Amoco Chemical Corporation (Chicago, IL) and Stackpole (Lowell, MA). Typical mixtures comprise about 0.1% to about 0.9% wt % of fibers.

The flow rate given the above described liquid flow varies from about 75 ml/min to about 600 ml/min. The amount of fibers mixed with the fluid can be adjusted by feedrate control equipment external to the nozzle assembly.

These methods provide smooth, uniform coatings. Specifically the atomizing spray guns provide accurate control without the clogging associated with typical needle valve controlled guns.

Although this invention has been shown and described with respect to detailed embodiments thereof, it will be understood by those skilled in the art that various changes in form and detail thereof may be made without departing from the spirit and scope of the claimed invention.

I claim:

1. A method of spraying a fiber-containing fluid comprising:

displacing a fiber-containing fluid through a nozzle assembly at pressures of about 69 KPa to about 386 KPa, said fibers having a length of about 1 mm to about 6 mm, said nozzle assembly comprising:

a) a nozzle extension, an elbow joint, and a nozzle in series communication through at least two hollow fluid passages;

b) said first fluid passage existing at a first nozzle outlet, said outlet having a diameter of about 2.5 mm to about 3.5 mm;

c) said fluid passage exiting at a second nozzle outlet for directing a gas at the fiber-containing fluid to atomize the fluid;

d) first control means for controlling the fiber-containing fluid flow disposed upstream of said nozzle assembly, said first control means comprising a pneumatic ball valve; and e) second control means for controlling the gas flow disposed upstream of said nozzle assembly.

* * * * *

UNITED STATES PATENT AND TRADEMARK OFFICE

CERTIFICATE OF CORRECTION

PATENT NO. : 4,917,298

DATED : April 17, 1990

INVENTOR(S) : David N. Henry

It is certified that error appears in the above-identified patent and that said Letters Patent is hereby corrected as shown below:

Column 4, Claim 1, line 13, "existing" should be --exiting--.

Signed and Sealed this

Thirtieth Day of July, 1991

*Attest:*

HARRY F. MANBECK, JR.

*Attesting Officer*

*Commissioner of Patents and Trademarks*